US005265281A

United States Patent [19]

McAlpine

[11] Patent Number: 5,265,281

[45] Date of Patent: Nov. 30, 1993

[54] STOPPERS FOR GARBAGE DISPOSAL UNIT INLETS

[75] Inventor: James E. McAlpine, Paisley, Scotland

[73] Assignee: McAlpine & Co. Ltd., United Kingdom

[21] Appl. No.: 910,815

[22] Filed: Jul. 9, 1992

[30] Foreign Application Priority Data

Apr. 7, 1992 [GB] United Kingdom ..... 9207567

[51] Int. Cl.[5] ..... E03C 1/262

[52] U.S. Cl. ..... 4/287; 4/290; 4/292

[58] Field of Search ..... 4/286-295; 241/46.015, 46.016

[56] References Cited

U.S. PATENT DOCUMENTS

| | | | |
|---|---|---|---|
| 3,096,527 | 7/1963 | Eynon | 4/287 |
| 3,181,801 | 5/1965 | Lung et al. | 241/46.015 |
| 3,430,871 | 4/1969 | Ross | 241/46.015 X |
| 4,359,788 | 11/1982 | Liou | 4/295 |

FOREIGN PATENT DOCUMENTS

| | | |
|---|---|---|
| 441358 | 1/1936 | United Kingdom . |
| 693343 | 6/1953 | United Kingdom . |
| 728976 | 4/1955 | United Kingdom . |
| 981507 | 1/1965 | United Kingdom . |
| 2103924 | 3/1983 | United Kingdom . |

OTHER PUBLICATIONS

"Eurodesign Creativity for the Disposer" undated brochure Opella Inc.

*Primary Examiner*—Charles E. Phillips
*Attorney, Agent, or Firm*—Pennie & Edmonds

[57] ABSTRACT

A decorative stopper is provided for fitting in the inlet of an existing garbage disposal unit located in a sink drain hole and provided with a sink flange. The stopper comprises a side wall defining a bore and carrying an external sealing member for releasably engaging the inner face of the bore of the existing sink flange, an upper flange extending radially outwardly from an upper end of the side wall for covering the upper face of the existing sink flange, a strainer member extending across the bore and a lower wall extending across the bore below the strainer member and including a plug member moveable between a sealing position and an open position in which fluid may drain through the stopper. A plug operating member extends upwardly from the plug member and through the strainer member to allow the plug member to be lifted to the open position.

7 Claims, 2 Drawing Sheets

STOPPERS FOR GARBAGE DISPOSAL UNIT INLETS

FIELD OF THE INVENTION

This invention relates to a stopper for the inlet of an existing garbage disposal unit located in a sink drain hole.

BACKGROUND OF THE INVENTION

Domestic garbage disposal units are commonly located below a sink drain hole so that waste for the disposal unit may be simply dropped or poured into the sink and washed down the drain hole into the unit. In such applications the sink drain hole is of considerably larger diameter than a conventional sink drain hole to permit passage of solid waste into the unit. It is known to block the drain hole using a large diameter plug of conventional form, however such plugs are considered unattractive and do not coordinate well with conventional basket strainers.

The sink provided in conjunction with the garbage disposal unit is often paired with a further, conventional sink unit. As mentioned above, the drain hole for the sink provided with the garbage disposal unit is likely to be of somewhat larger diameter than the standard sink drain hole and, unless provided with a large diameter plug as described above, will present a large diameter open hole in the bottom of the sink and may result in objects inadvertently entering the garbage disposal unit. Also, the unit inlet is typically provided with a metal sink flange which provides a sealed connection between the sink and the inlet of the disposal unit. This sink flange may detract from the appearance of the sink unit provided with the disposal unit and create difficulties for the householder wishing to co-ordinate the appearance of adjacent sink units.

SUMMARY OF THE INVENTION

It is among the objects of the present invention to obviate or mitigate at least some of these disadvantages.

Accordingly, the present invention provides a decorative stopper for the inlet of an existing garbage disposal unit located in a sink drain hole and provided with a sink flange, the stopper comprising: a side wall defining a bore and carrying external sealing means for releasably engaging the inner face of the bore of an existing sink flange and downwardly extending wall; an upper flange extending radially outward from an upper end of the side wall for covering the upper face of the existing sink flange; a strainer member extending across the bore; a lower wall extending across the bore below the strainer member and including a plug member moveable between a sealing position and an open position in which fluid may drain through the stopper; and a plug operating member extending upwardly from the plug member and through the strainer member.

In use, the stopper allows sink units incorporating a garbage disposal unit to be releasably stoppered such that the sink may be used in a conventional manner, the provision of the strainer member allowing water to be drained from the sink while retaining solids, such as vegetables which have been cleaned in the sink; and upon removal of the stopper by disengagement of the sealing ring and the downwardly extending wall, access to the garbage disposal unit is provided. Also, the stopper may be formed of plastics material, coloured as desired, and having a similar appearance to the plug or strainer of an adjacent sink unit provided with a conventional drain outlet.

Preferably, the stopper is formed of two parts, a first part incorporating the side wall, the upper flange and the lower wall and the second part incorporating the strainer member, the plug member and the plug operating member. Most preferably the parts may be snap-fitted together permitting parts of different colours to be utilised in the one stopper for closer colour co-ordination with other kitchen fittings.

Preferably also, the plug operating member is movable between a first raised configuration in which the plug member is open and a second lowered configuration in which the plug member closes the stopper. Most preferably, the plug member may be sealingly located over an opening in the lower wall.

BRIEF DESCRIPTION OF THE DRAWINGS

This and other aspects of the present invention will now be described, by way of example, with reference to the accompanying drawings, in which.

DETAILED DESCRIPTION OF THE DRAWINGS

Figure 1:
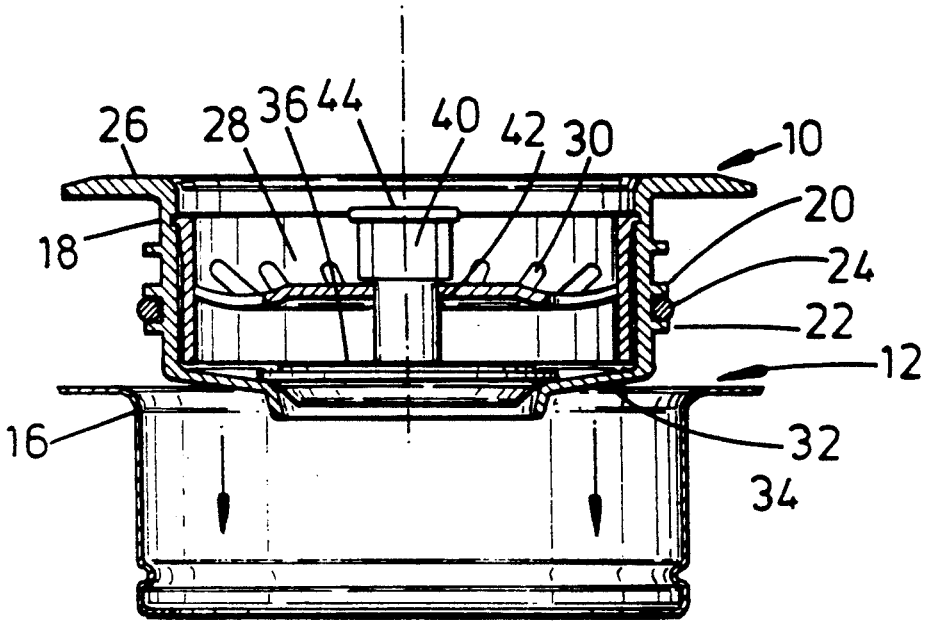
FIG. 1 is a sectional view of a stopper in accordance with a preferred embodiment of the present invention prior to insertion in a sink flange.
Figure 1A:
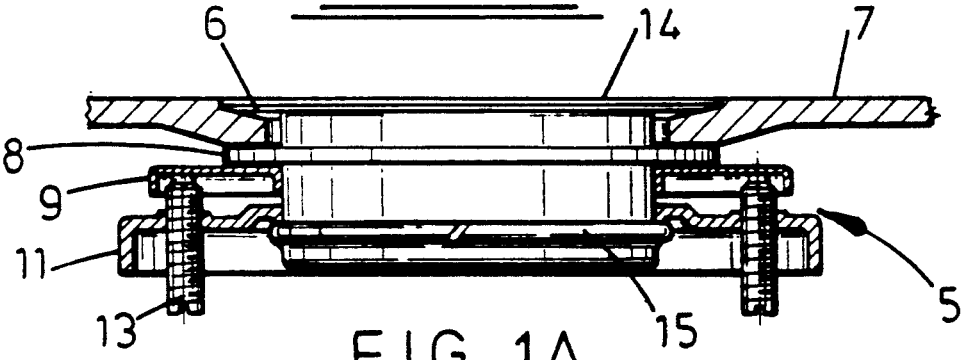
FIG. 1A is a sectional view of a sink provided with the sink flange of FIG. 1 and the associated garbage disposal unit mounting assembly, shown somewhat reduced.
Figure 2:
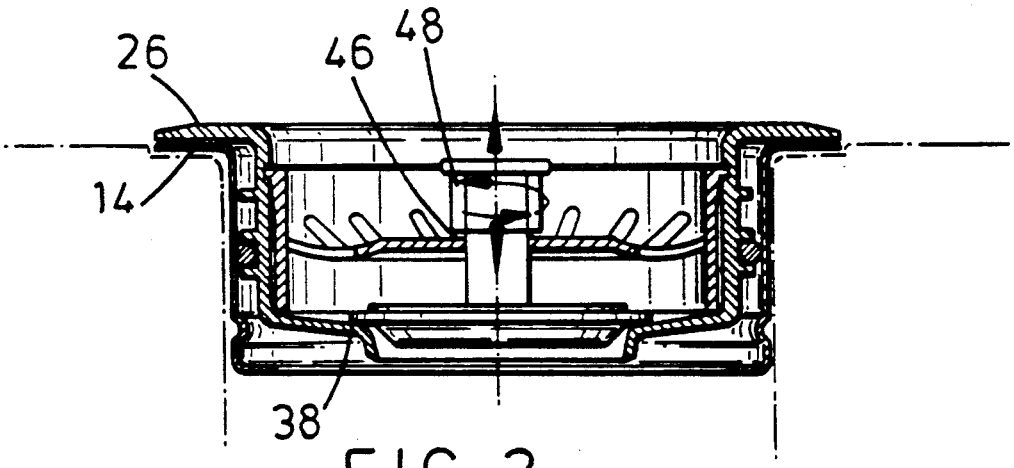
FIG. 2 shows the stopper of FIG. 1 fitted in the sink flange.
Figure 3:
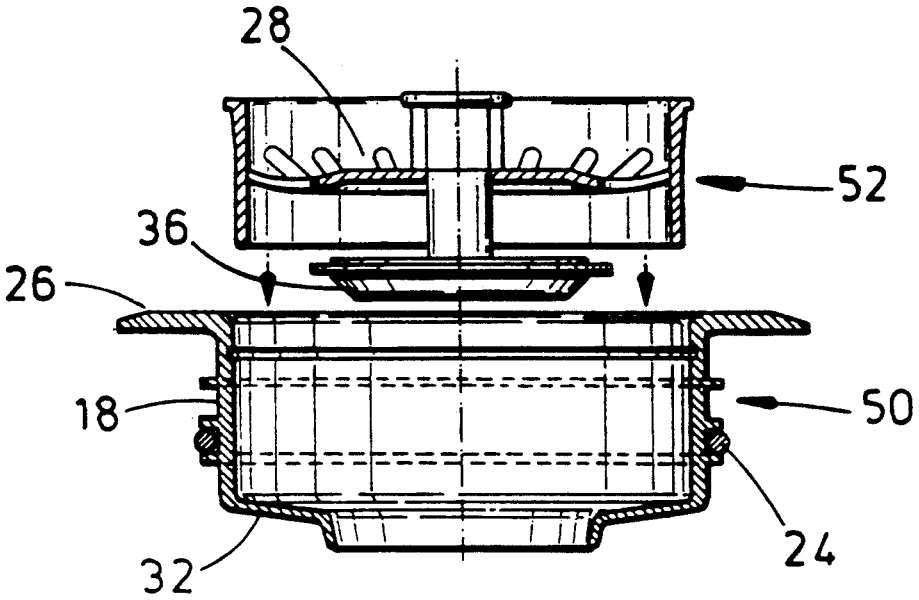
FIG. 3 is a sectional view of the stopper of FIG. 1, showing two parts of the stopper separated.
Figure 4:
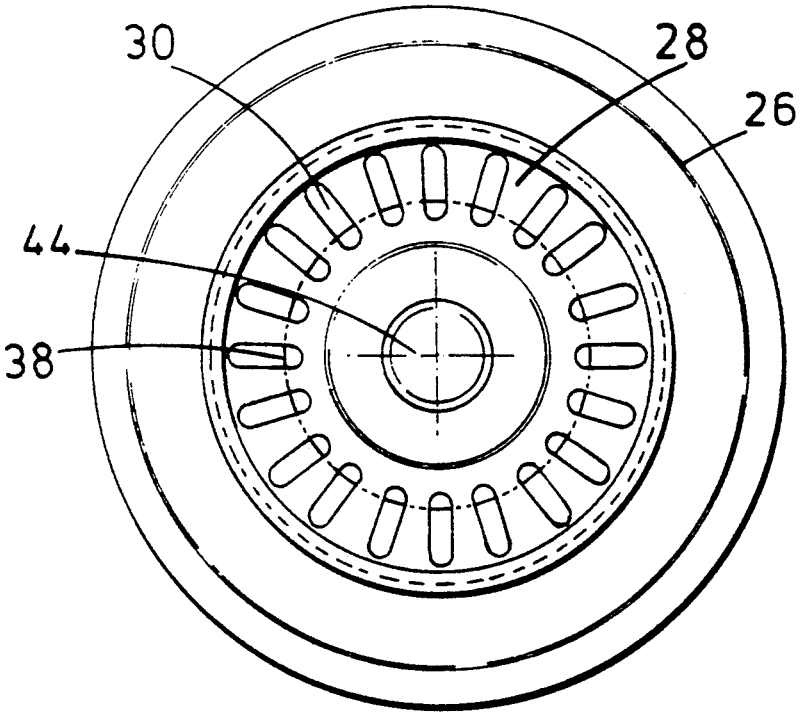
FIG. 4 is a plan view of the stopper of FIG. 1.

The drawings show a decorative stopper 10 in accordance with a preferred embodiment of the present invention for location in the inlet of an existing garbage disposal unit in a sink drain hole and provided with a sink flange 12 as shown in FIGS. 1 and 2 of the drawings. The sink flange 12 has an annular flange portion 14 and a cylindrical side wall 16 and is formed of stainless steel. The flange portion is normally held in sealing engagement with the base of the sink around the drain hole while the side wall 16 extends into the mounting assembly 5 for a garbage disposal unit inlet, as shown in FIG. 1A of the drawings. In this example a putty seal 6 is positioned between the sink 7 and the flange portion 14, the assembly 5 further including a fibre gasket 8, a metal back-up ring 9, a triangular mounting ring 11 provided with three seating screws 13, and a metal snap-ring 15. The disposal unit (not shown) hangs from the mounting ring 11.

The stopper 10 has a body including a side wall 18 provided with circumferential ribs 20, 22 for locating a sealing O-ring 24 for sealingly engaging the side wall 16 of the sink flange 12. An upper flange portion 26 extends radially outwards from the upper end of the side wall 18 and has a radial extent at least equal to and preferably greater than the flange portion 14 of the sink flange 12 such that, when the stopper 10 is located in the sink flange 12, the flange portion 14 is concealed by the flange portion 26.

A strainer member 28 extends inwardly of the side wall 18 across the bore and is provided with a plurality of circumferentially spaced openings 30. Below the strainer member 28, a lower wall portion 32 extends inwardly of the side wall 18 to define a central opening 34 which may be closed by a plug member 36 movable between a sealing position, as shown in FIG. 2, and an open position in which fluid may drain around the plug member 36 and through the opening 34. The plug member 36 is generally circular and has a peripheral sealing bead 38 of resilient material for engaging the lower wall portion 32 surrounding the opening 34. A centrally located plug operating member 40 is fixed to the plug member 36 and extends upwardly through a central aperture 42 in the strainer member 28. The operating member 40 has an end cap 44, the lower face of which abuts the upper end of a bushing 46 formed integrally with the strainer member 28. Axial ribs 48 extend downwardly from the end cap 44 for location in slots (not shown) in the bushing 46. The slots are of different depths such that the operating member 40 may position the plug member 36 to close the opening 34 or may be supported by the bushing to lift the plug member 36 clear of the opening 34.

The stopper 10 is formed of two parts 50, 52, the first part 50 incorporating the side wall 18, the flange portion 26 and the lower wall portion 32 and the second part 52 incorporating the strainer member 28 and the plug member 36. The second part 52 also includes an inner side wall 54, the upper edge of which is provided with a radially extending rib 56 for snap-fitting engagement with a corresponding circumferential slot 58 provided in the side wall 16. This construction facilitates manufacture of the stopper and also allows parts 50, 52 of, for example, different colours of plastic material to be utilised.

It will be clear to those of skill in the art that the above described embodiment is merely exemplary of the present invention and various modifications and improvements may be made to the stopper without departing from the scope of the present invention.

I claim:

1. A strainer/stopper for the inlet of an existing garbage disposal unit located below a sink drain opening, the opening defined by a sink flange and a downwardly extending wall, the stopper comprising:

a side wall defining a bore on one side and carrying on the other side a sealing ring for releasably engaging the downwardly extending wall so as to provide a seal for prevention of the passage of water between said side wall and the downwardly extending wall and allowing removal of said side wall from the downwardly extending wall so as to provide access to the existing garbage disposal unit;

an upper flange extending radially outward from an upper end of the side wall for covering an upper face of the sink flange;

a strainer member extending across the bore;

a lower wall extending partially across the bore below the strainer member and defining an opening, a plug member moveable between a sealing position engaging said opening and an open position in which fluid may drain through said opening; and a plug operating member extending upwardly from the plug member and through the strainer member, wherein said plug member may engage the periphery of the opening so as to prevent passage of water therethrough or said operating member may seat on said strainer member in a position to allow passage of water through said opening.

2. The stopper of claim 1 wherein the stopper is formed of two parts, a first part incorporating the side wall, the upper flange and the lower wall and the second part incorporating the strainer member, the plug member and the plug operating member.

3. The stopper of claim 2 wherein the first and second part are snap-fitted together.

4. The stopper of claim 3 wherein the second part includes an inner side wall, the upper edge of said inner wall being provided with a radially extending rib for snap-fitting engagement with a corresponding circumferential slot provided in the side wall.

5. The stopper of claim 1 wherein the plug member is generally circular and has a peripheral sealing bead of resilient material for engaging the lower wall portion surrounding the open.

6. The stopper of claim 1 wherein the operating member includes an end cap, having a lower face for abutting the upper end of a bushing provided on the strainer member, axial ribs extending downwardly from the end cap for location in slots defined in the bushing, the slots being of different depths such that the operating member may position the plug member to close the opening or may be supported by the bushing to lift the plug member clear of the opening.

7. The stopper of claim 1 wherein the sealing means is a sealing O-ring positioned between circumferential ribs provided on the exterior of the side wall.

* * * * *